United States Patent [19]

Katsukawa

[11] Patent Number: 4,668,114

[45] Date of Patent: May 26, 1987

[54] PRINTER WITH A DEVICE FOR PREVENTING PRINT HEAD FROM INTERFERING WITH TEMPORARY BINDER PORTIONS OF MULTIPLE-SHEET RECORDING MEDIUM

[75] Inventor: Satoshi Katsukawa, Chiryu, Japan

[73] Assignee: Brother Kogyo Kabushiki Kaisha, Japan

[21] Appl. No.: 836,382

[22] Filed: Mar. 5, 1986

[30] Foreign Application Priority Data

Mar. 8, 1985 [JP] Japan ..... 60-46785

[51] Int. Cl.[4] ..... B41J 19/14; B41J 19/30

[52] U.S. Cl. ..... 400/279; 400/323; 400/342; 400/355

[58] Field of Search ..... 400/279, 280, 320, 320.1, 400/322, 323, 323.1, 328, 342–344, 355, 705, 705.1

[56] References Cited

U.S. PATENT DOCUMENTS

| | | | |
|---|---|---|---|
| 3,858,703 | 1/1975 | Duley | 400/124 |
| 3,970,183 | 7/1976 | Robinson | 400/323 X |
| 4,179,223 | 12/1979 | Kwan | 400/279 X |
| 4,180,335 | 12/1979 | Yamada | 400/322 X |

FOREIGN PATENT DOCUMENTS

| | | | |
|---|---|---|---|
| 54-27808 | 3/1979 | Japan | 400/342 |
| 57-144555 | 9/1982 | Japan | 400/342 |
| 57-72052 | 5/1983 | Japan | 400/342 |

*Primary Examiner*—Paul T. Sewell

*Attorney, Agent, or Firm*—Parkhurst & Oliff

[57] ABSTRACT

A serial printer adapted to print on a recording medium consisting of a plurality of paper sheets stacked on each other and temporarily bound with temporary binding or fastening portions provided along opposite side edges of the medium. The printer has a first memory for storing the rightmost character position of a current line, and a second memory for storing the position of the rightmost character of all the characters of previous lines printed in a rightward direction, or the position of the rightmost character of all the characters of all previously printed lines. When the rightmost character of the current line is located to the left of the rightmost character whose position is stored in the second memory, the medium is advanced to the next line. However, if the rightmost character of the current line is located at the same position as, or to the right of, the rightmost character whose position is stored in the second memory, a print head is first moved leftward at the end of rightward printing of the current line, before the medium is advanced, whereby the medium can be fed to the next line without interference of the temporary binding portions with the print head. Similar arrangement is possible for feeding the medium while the print head is located adjacent to the left edge of the medium.

6 Claims, 5 Drawing Figures

PRINTER WITH A DEVICE FOR PREVENTING PRINT HEAD FROM INTERFERING WITH TEMPORARY BINDER PORTIONS OF MULTIPLE-SHEET RECORDING MEDIUM

BACKGROUND OF THE INVENTION

1. Field of the Art

The present invention relates to a serial printer which is capable of printing on a multiple-copy or multiple-sheet recording medium consisting of a plurality of sheets superposed over each other, and more particularly to a device for preventing a print head of the printer from interfering with temporary binder or fastener means provided along opposite lateral edges of the recording medium.

2. Related Art Statement

In the art of printing on a recording medium of the type indicated above, the recording medium in the form of a stack of paper sheets has feed perforations formed in spaced-spart relation along the side or lateral edges of the medium, so that the recording medium may be fed through engagement of the feed perforations with sprockets formed on sprocket wheels or belts of a printer. Where such a multiple-sheet recording medium consists of five or six sheets of paper or more stacked on each other, the uppermost and lowermost sheets of the stack tend to be displaced relative to the inner sheets. To avoid this displacement, the component paper sheets of the stack are temporarily bound with suitable temporary binding or fastening means which are formed between the feed perforations, for example, by so-called "paper Hotchkiss" punches, so as to create narrow strips that are partially punched-out portions of the sheets and connected at their one side to the sheets. The punched-out portions serve to bind or fasten the sheets together. But, the narrow strips of the temporary binding means partially connected to the multiple-sheet medium may be upraised above the surface of the medium when it is fed through a paper guide in the printer, thereby giving the medium local upraised areas which may interfere with a print head. In this event, the medium may be jammed and damaged between the print head and a platen.

When a line of characters is printed from left to right, for example, within a preset range, the print head is moved a certain distance beyond the rightmost character position, before a carriage carrying the print head is decelerated and finally stopped. This distance of movement is also required for accelerating the carriage to a normal printing speed before the print head starts printing a first character of each line, which is either the rightmost or the leftmost character of the line. Therefore, when the rightmost or leftmost character is located near the corresponding edge of the medium, i.e., near the temporary binding portions, the print head may be located between the upper and lower temporary binding portions after the print head has printed the last character of a line, or before the print head starts printing the first character of a line, irrespective of whether that line is printed in a rightward direction or in a leftward direction. If the recording medium is advanced to the next line in the above-indicated condition, the print head may interfere with the lower temporary binding portion.

To prevent an interference of the print head with temporary binding portions, and consequent damages to the medium, it is proposed to move the print head in a direction away from the binding portions at the end of printing of each line, and before the medium is advanced to the next line. An alternative proposal to solve the inconveniences in question is to use a sensor for detecting the temporary binding portions so as to move the carriage and the print head away from the detected binding portions if the print head is located within a margin area which overlaps the temporary binding portions.

PROBLEMS SOLVED BY THE INVENTION

In the serial printer incorporating the protective means according to the former proposal wherein the print head is moved away from the temporary binding portions at the end of each and every line of characters, the overall printing efficiency is accordingly reduced due to non-printing times spent prior to advancement of the recording medium to the next line. On the other hand, the latter proposal leads to increased cost of the printer due to the use of an expensive sensor and related components for detecting the temporary binding portions provided along the lateral edges of the medium.

SUMMARY OF THE INVENTION

It is accordingly an object of the present invention to provide a printer for printing on a multiple-sheet recording medium as indicated above, which has a device for preventing the print head from interfering with temporary binding means of the medium, and which is high in printing efficiency and economical to manufacture.

According to the present invention, there is provided a serial printer for printing on a recording, medium consisting of a plurality of sheets which are superposed on each other and temporarily bound together with temporary binding means provided along opposite lateral edges of the medium, comprising: (a) a generally elongate platen for holding the recording medium; (b) feed means for feeding the recording medium in a direction perpendicular to a length of the generally elongate platen; (c) a print head disposed opposite to the platen, for effecting printing on the recording medium; (d) a carriage which supports the print head and is movable along the platen; (e) carriage drive means for moving the carriage along the platen; (f) first memory means for storing rightmost position data of a current line of characters printed by the print head, the rightmost position data being indicative of a position of a rightmost character of the current line; (g) second memory means for storing rightmost position data of a first previous line of characters whose rightmost character is the rightmost character of all the characters of at least previous lines which have been printed in a rightward direction before the current line of characters is printed is printed, the rightmost position data of the first previous line being indicative of a position of the rightmost character of the first previous line; (h) comparator means for comparing the rightmost position data of the current line with the rightmost position data of the first previous line, and producing a first position signal indicating the position of the rightmost character of the current line with respect to the position of the rightmost character of the first previous line; and (i) control means responsive to the first position signal from the comparator means, for activating only the paper feed means to advance the recording medium to a next line, at the end of printing of the current line in said rightward direction, if the first position signal indicates that the rightmost character of the current line is located to the left of the rightmost character of the first previous line, the control means activating the carriage drive means to move the carriage in a leftward direction by a predetermined distance at the end of printing of the current line, before activating the paper feed means to advance the recording medium to the next line, if the first position signal indicates that the rightmost character of the current line is located at the same position as, or to the right of, the rightmost character of the first previous line.

In the serial printer of the present invention constructed as described above, the carriage and the print head are moved leftward away from the temporary binding means at the end of rightward printing of the current line, before the recording medium is advanced to the next line, only if the rightmost character of the current line is located at the same position as, or to the right of, the rightmost character of the first previous line indicated above. If the rightmost character of the current line is located to the left of the rightmost character of the first previous line, however, the recording medium is advanced to the next line immediately after the carriage and the print head have reached the rightmost end of the current line. This arrangement of the invention not only makes it possible to protect the recording medium and the print head against an undesirable interference with each other, and consequent jamming and damage of the recording medium, but also is effective to minimize the reduction in overall printing efficiency due to non-printing movements of the print head away from the temporary binding means. Further, the instant arrangement does not require the use of an expensive sensor for detecting the temporary binding means, and therefore permits the printer to be offered at a comparatively low cost.

According to one advantageous embodiment of the invention, the rightmost position data to be stored in the second memory means is indicative of the rightmost character of all the characters of all previous lines which have been printed by the print head before the current line of characters is printed.

According to another advantageous embodiment of the invention, the first memory means further stores leftmost position data of the current line indicative of a position of a leftmost character of the current line, and the second memory means further stores leftmost position data of a second previous line of characters whose leftmost character is the leftmost character of all the characters of at least previous lines which have been printed in a leftward direction before the current line of characters is printed, the leftmost position data of the second previous line being indicative of a position of the leftmost character of the second previous line. In this case, the comparator means is adapted to also compare the leftmost position data of the current line with the leftmost position data of the second previous line, and producing a second position signal indicating the position of the leftmost character of the current line with respect to the position of the leftmost character of the second position line. The control means is responsive to the second position signal from the comparator means, for activating only the paper feed means to advance the recording medium to the next line, at the end of printing of the current line in the leftward direction, if the second position signal indicates that the leftmost character of the current line is located to the right of the leftmost character of the second previous line. If the second position signal indicates that the leftmost character of the current line is located at the same position as, or to the left of, the leftmost character of the second previous line, the control means activates the carriage drive means to move the carriage in a rightward direction by a predetermined distance at the end of printing of the current line, before activating the paper feed means to advance the recording medium to the next line.

In the above embodiment, the print head is also prevented from interfering with the temporary binding means provided along the left edge of the recording medium. In this case, too, the reduction in printing efficiency due to non-printing movement of the print head away from the left edge of the medium is held at a minimum, because the non-printing movements of the print head occur only when the leftmost character of the current line is located at the same position as, or to the left of, the leftmost character of all the previously printed characters.

According to a further advantageous embodiment of the invention, the serial printer may further comprise detector means for sensing the recording medium and producing a detection signal indicating an end of the recording medium when the recording medium is not sensed, and means responsive to the detection signal from the detector means, for resetting the contents of the second memory means to a predetermined initial setting. This initial setting is determined so as to cause the carriage to be moved in the leftward direction at the end of rightward printing of a first line of each recording medium.

According to another aspect of the invention, there is provided a serial printer having the platen, feed means, print head, carriage, and carriage drive means, which are constructed as previously described, the serial printer comprising: first memory means for storing leftmost position data of a current line of characters printed by the print head, the leftmost position data being indicative of a position of a leftmost character of the current line; second memory means for storing leftmost position data of a previous line of characters whose leftmost character is the leftmost character of all the characters of at least previous lines which have been printed in a leftward direction before the current line of characters is printed, the leftmost position data of the previous line being indicative of a position of the leftmost character of the previous line; comparator means for comparing the leftmost position data of the current line with the leftmost position data of the previous line, and producing a position signal indicating the position of the leftmost character of the current line with respect to the position of the leftmost character of the previous line; and control means responsive to the position signal from the comparator means, for activating only the paper feed means to advance the recording medium to a next line, at the end of printing of the current line in said leftward direction, if the position signal indicates that the leftmost character of the current line is located to the right of the leftmost character of the previous line, the control means activating the carriage drive means to move the carriage in a rightward direction by a predetermined distance at the end of printing of the current line, before activating the paper feed means to advance the recording medium to the next line, if the position signal indicates that the leftmost character of the current line is located at the same position as, or to the left of, the leftmost character of the previous line.

BRIEF DESCRIPTION OF THE DRAWINGS

The above and other objects, features and advantages of the present invention will be better understood by reading the following detailed description of a preferred embodiment of the invention, when considered in connection with the accompanying drawings, in which.

DETAILED DESCRIPTION OF THE PREFERRED EMBODIMENT

To further clarify the concept of the present invention, the preferred embodiment of the invention will be described in greater detail, by reference to the several figures of the accompanying drawings.

Figure 1:
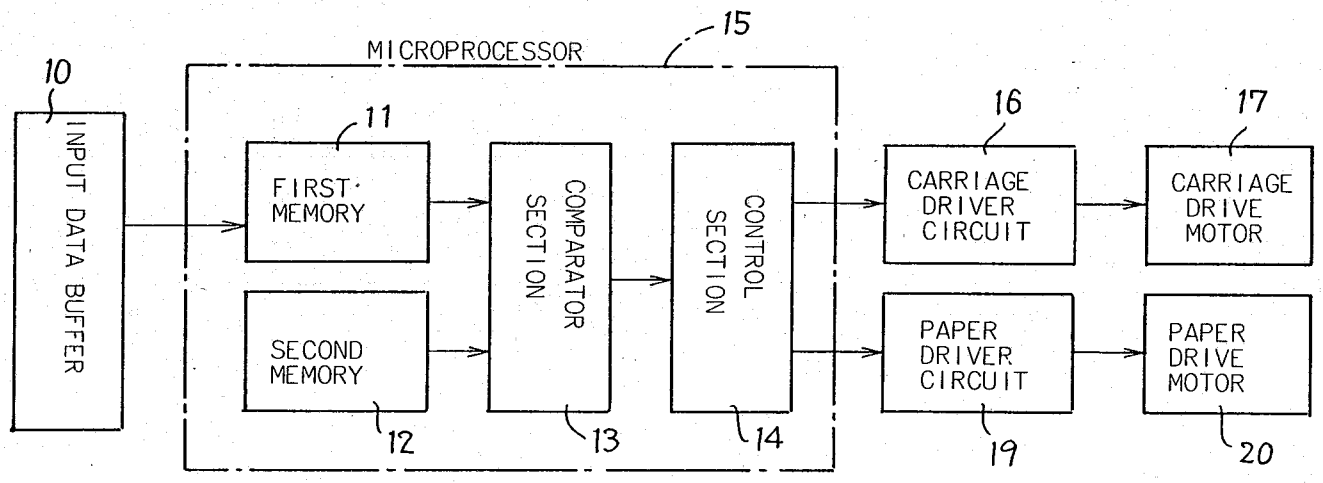
FIG. 1 is a schematic block diagram illustrating a control arrangement of one embodiment of a serial printer of the present invention.

Referring first to FIG. 1, there is shown a general control arrangement of the serial printer, which includes an input data buffer 10 for temporarily storing printing data, and a microprocessor which comprises a central processing unit, a read-only memory, and a random-access memory, as well known in the art. Reference numeral 15 in FIG. 1 designates such a microprocessor which includes functionally different portions indicated at 11, 12, 13 and 14. More specifically, the microprocessor 15 includes a first memory 11, a second memory 12, a comparator section 13, and a control section 14.

The first memory 11 is provided to store rightmost position data and leftmost position data, which are respectively indicative of the positions of the rightmost and leftmost characters of a current line of characters which are represented by the input printing data currently transferred from the input data buffer 10 to the microprocessor 15. As described later in more detail, the second memory 12 is provided to store rightmost position data which is indicative of the position of the rightmost character of all the characters in the previous lines which have been printed in the rightward direction, and also leftmost position data which is indicative of the position of the leftmost character of all the characters in the previous lines which have been printed in the leftward direction.

The comparator section 13 compares the rightmost and the leftmost position data in the first memory 11 with the rightmost and the leftmost position data in the second memory 12, respectively, and applies a first and a second position signal to the control section 14. As described later, the first position signal indicates the position of the rightmost character of the current line of characters, with respect to the position of the rightmost character of all the characters of the previous lines printed in the rightward direction. On the other hand, the second position signal indictes the position of the leftmost character of the current line, with respect to the leftmost character of all the characters of the previous lines printed in the leftward direction.

The control section 14 serves to control a carriage drive motor 17 and a paper feed motor 20 through a carriage driver circuit 16 and a paper driver circuit 19, respectively. Further, the control section 14 functions to hold or update the contents of the second memory 12, according to the first and second position signals from the comparator 13. These control operations of the control section 14 are executed according to a control program illustrated in the flow chart of FIG. 4, which is stored in the read-only memory provided in the microprocessor 15.

Figure 2:
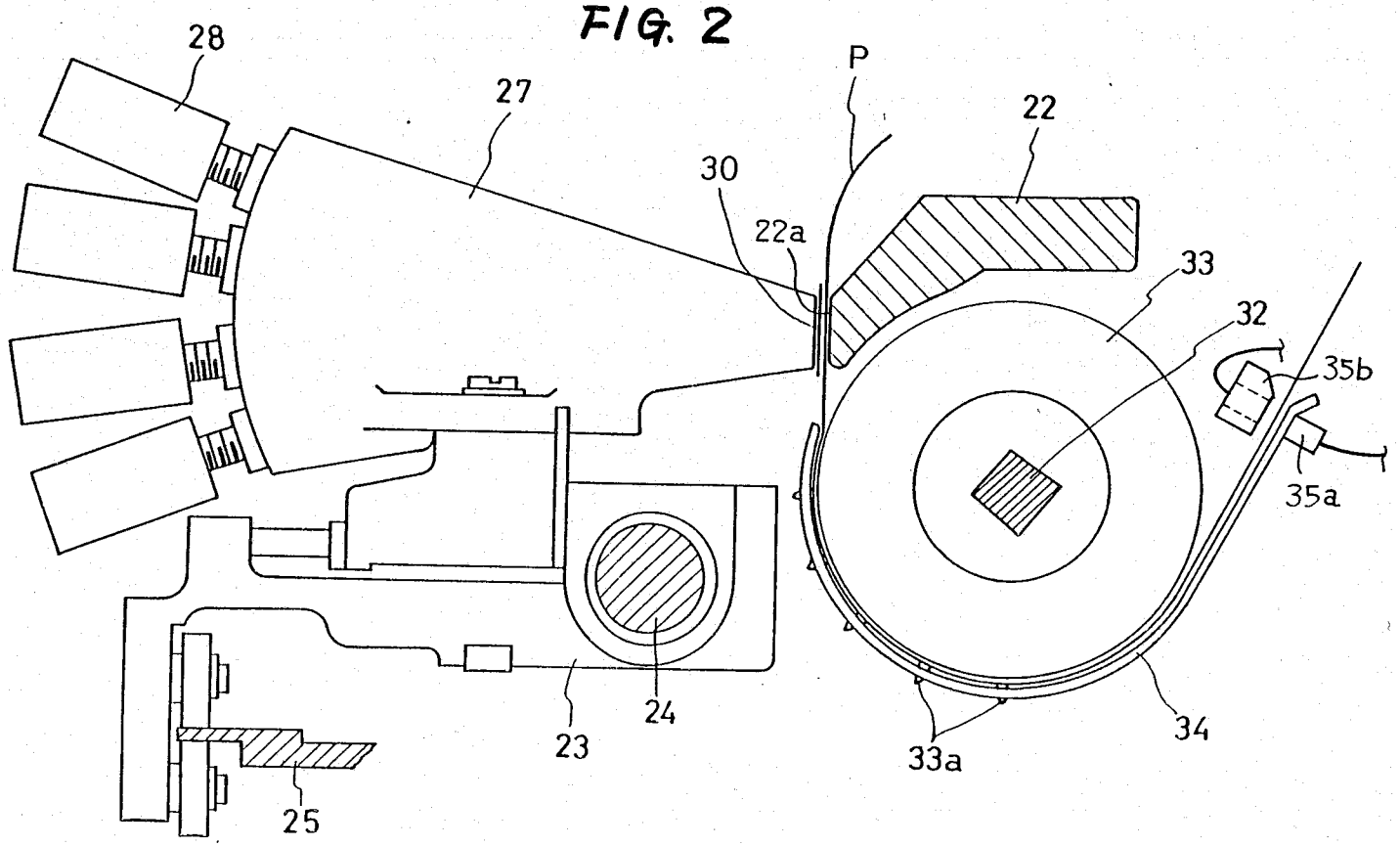
FIG. 2 is a fragmentary elevational view partly in cross section of a structural arrangement of the serial printer of FIG. 1.
Figure 3:
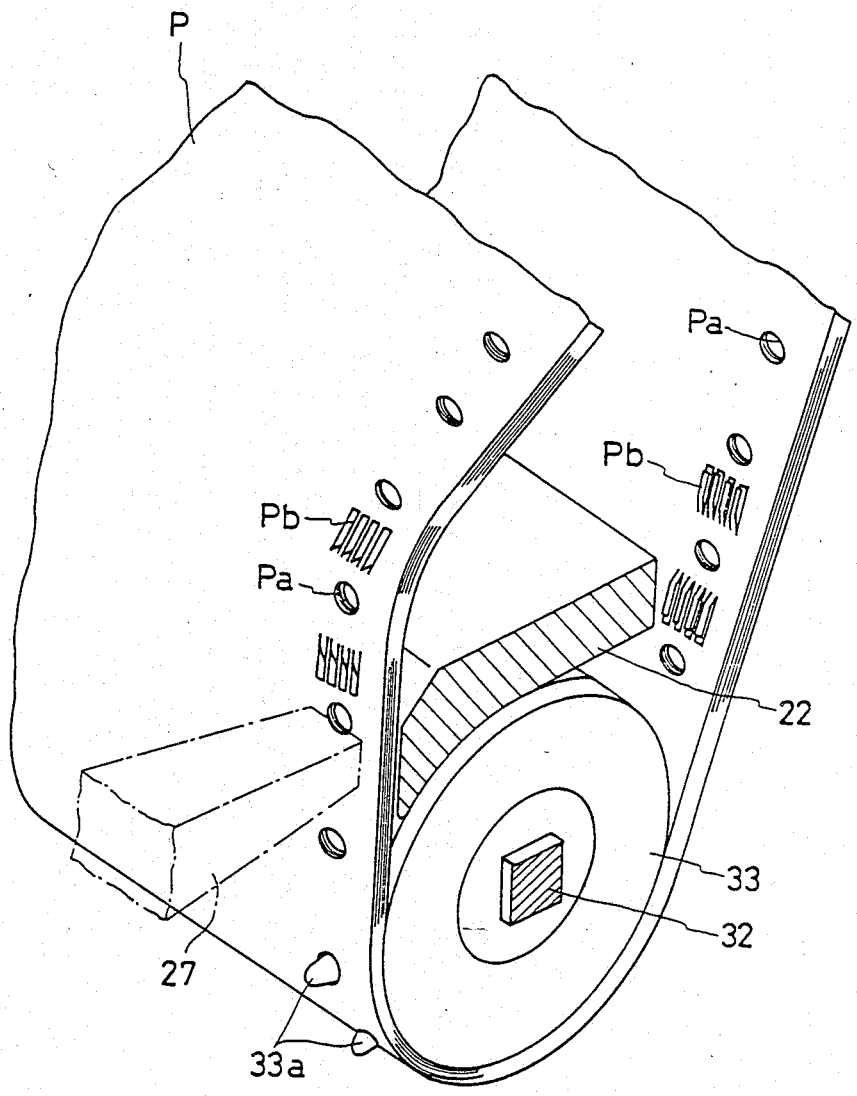
FIG. 3 is a fragmentary perspective view of the structural arrangement of FIG. 2.

Referring next to FIGS. 2 and 3, there is illustrated a structural arrangement of the serial printer, wherein a generally elongate platen 22 is fixed to a printer frame (not shown). The platen 22 has a smooth upright front surface 22*a*. In the meantime, a guide rod 24 and a guide plate 25 are also fixed to the printer frame such that they extend parallel to the elongate platen 22. The guide rod 24 and the guide plate 25 cooperate to support a carriage 23 slidably along the plate 22. The carriage 23 is driven by a carriage drive motor 17 (indicated in FIG. 1).

A print head 27 is mounted on the carriage 23 such that its printing end faces the upright front surface 22*a* of the platen 22. The print head 27 is a dot-matrix printing head which has a multiplicity of print wires (not shown) that are selectively driven by respective electromagnets 28. Upon activation of the print wires, the printing ends of the wires are impacted via a ribbon 30 against a recording medium in the form of a multiple-sheet paper material P (hereinafter referred to as "paper stack") which is fed between the upright front surface 22*a* of the platen 22 and the ribbon 30. Thus, a desired character represented by the corresponding printing data is printed in a corresponding matrix of dots.

The paper stack P consists of multiple sheets of paper superposed on each other in a stack, and has parallel rows of feed perforations Pa which are formed along and near the opposite lateral or side edges. The feed perforations Pa in each row are spaced apart from each other by a suitable distance. Between the feed perforations Pa, there are formed temporary binding or fastening portions Pb which function to temporarily bind the multiple sheets together. Each of these temporary binding portions Pb arranged in two rows corresponding to the rows of the feed perforations Pa, consists of narrow rectangular parallel strips which are partially punched-out portions of the paper sheets, each of which is connected at one of its opposite short sides to the corresponding sheet.

A drive shaft 32 is supported on the printer frame, rotatably by a paper feed motor 20 (FIG. 1). The drive shaft 32 supports a pair of sprocket wheels 33 such that these wheels 33 are not rotatable relative to the shaft 32, but are slidable on the shaft 32 in the axial direction. The distance of the two sprocket wheels 32 is adjusted depending upon the specific width of the paper stack P. The sprocket wheels 33 have teeth or sprockets 33*a* which project from its periphery so as to be engageable with the feed perforations Pa formed in the paper stack P. A paper guide 34 is disposed so as to extend along a lower part of the periphery of the sprocket wheels 33. With the sprocket wheels 33 rotated by the paper feed motor 20 in the clockwise direction (in FIG. 2), the paper stack P is fed along the paper guide 34 toward the platen 22, with the sprockets 33*a* engaging the feed perforations Pa.

At the paper-inlet side end of the paper guide 34, there is disposed a paper detector which consists of a light-emitting element 35*a* connected to a suitable power source, and a light-sensitive element 35*b* which is adapted to receive a light beam emitted from the light-emitting element 35*a*. The light-sensitive element 35*b* supplies the microprocessor 15 with a signal indicating whether the paper stack P is present between the elements 35*a* and 35*b*. Thus, the paper detector 35*a*, 35*b* is capable of sensing the leading and trailing ends of the paper stack P.

Figure 4:
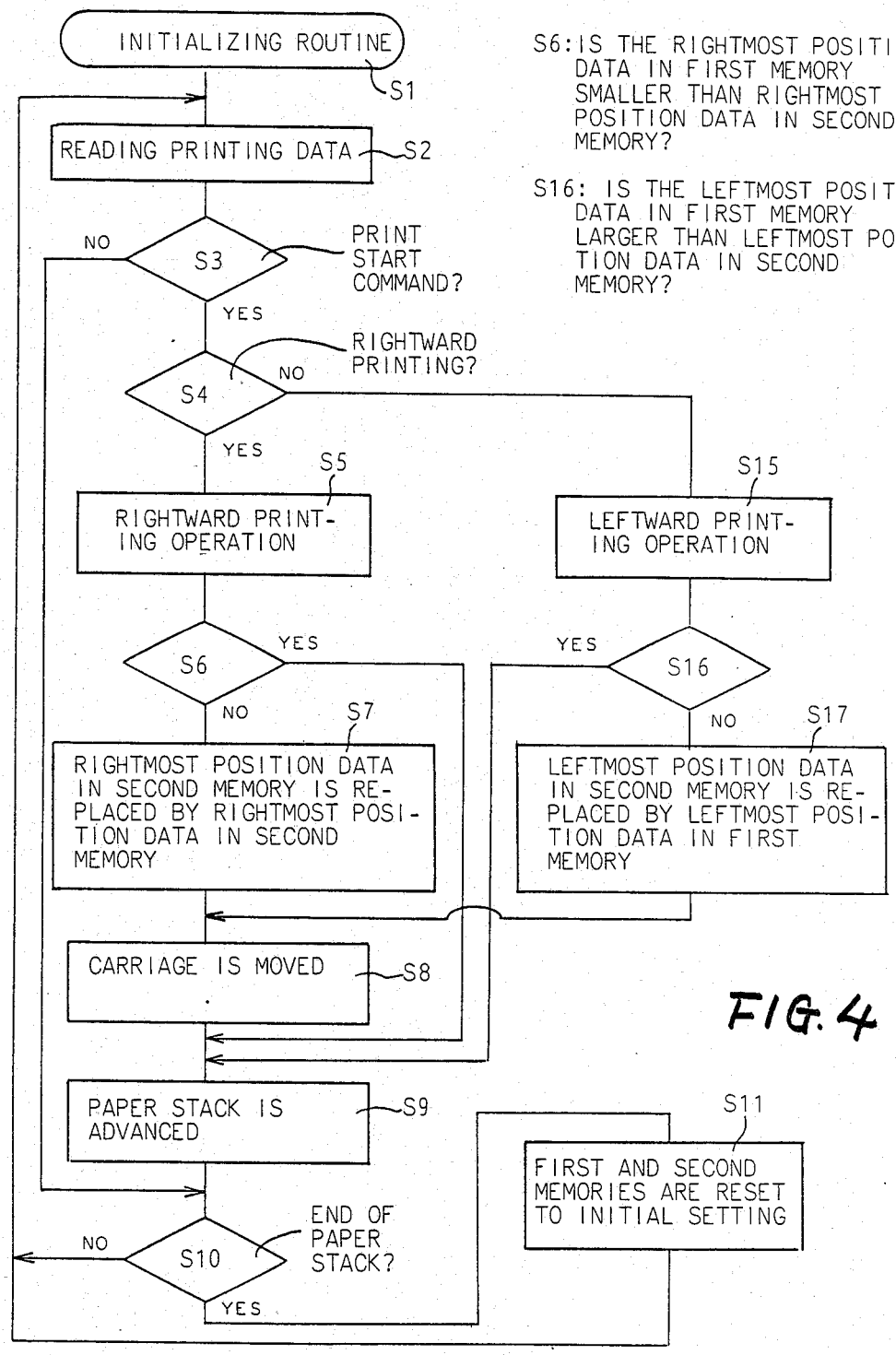
FIG. 4 is a flow chart showing an operation of the serial printing.

Referring further to FIG. 4, the operation of the serial printer described hitherto will be described. For easy understanding, events of the operation are indicated by step numbers preceded by letter S.

Upon application of power to the printer with the paper stack P inserted through rotation of the sprocket wheels 33, step S1 is performed to execute a predetermined initializing routine, wherein the carriage drive motor 17 is operated to position the print head 17 to its home position near the left-hand side edge of the paper stack P, and the first and second memories 11, 12 are reset to their initial setting. Then, the microprocessor 15 goes to step S2 to receive printing data representative of a character, from the input data buffer 10. This step S2 is repeated until a PRINT START command is received. That is, a set of printing data representative of a line of characters is followed by the PRINT START command which commands the printer to start printing that line of characters. To check for the PRINT START command, step S2 is followed by step S3 to check if the PRINT START command has been received. When the microcomputer 15 receives the printing data of each line of characters, the first memory 11 stores the previously defined rightmost and leftmost position data of the line, in the form of numerical values representing the number of columns as counted from the reference position which is the leftmost column of a preset printing range. Each column corresponds to a character or a space. For example, the printing range consists of 136 columns.

If the PRINT START command has not been received, step S3 is followed by step S10 which will be described. If the PRINT START command has been received, the microprocessor 15 goes to step S4 to check if the line of characters represented by the printing data received should be printed in the rightward direction, or not.

In the case where the line of characters should be printed in the rightward direction, step S4 is followed by step S5 wherein the line of characters is printed from left to right. Subsequently, the microprocessor 15 goes to step S6 wherein the comparator section 13 compares the numerical value of the rightmost position data of the printed line stored in the first memory 11, with the numerical value of the rightmost position data stored in the second memory 12, to check if the rightmost character of the currently printed line is located to the left of the rightmost position represented by the rightmost position data stored in the second memory 12. If the result of judgement in step S6 is affirmative (YES), step S6 is followed by step S9 which will be described. If the result of judgement is negative (NO), step S6 is followed by step S7 in which the rightmost position data in the second memory 12 is replaced by the rightmost position data in the first memory 11. Successively, step S8 is executed as described later in detail.

If the judgement in step S4 indicates that the current line of characters should be printed in the leftward direction, the microprocessor 15 goes to step S15 to print that line from right to left, and then goes to step S16 wherein the comparator section 13 compares the numerical value of the leftmost position data of the printed line stored in the first memory 11, with the numerical value of the leftmost position data stored in the second memory 12, to check if the leftmost character of the currently printed line is located to the right of the leftmost position represented by the leftmost position data stored in the second memory 12. If the result of judgement in step S16 is affirmative (YES), step S16 is followed by step S9. If the result of judgement is negative (NO), step S16 is followed by step S17 in which the leftmost position data in the second memory 12 is replaced by the leftmost position data in the first memory 11. Step S17 is followed by step S8.

In step S8, the control section 14 of the microcomputer 14 commands the carriage drive circuit 16 so as to operate the carriage drive motor 17 in the appropriate direction. Namely, if the current line of characters has been printed in the rightward direction and the print head 27 is located at the right end of the printed line, the carriage drive motor 17 is operated to move the carriage 23 in the leftward direction by a predetermined distance "A" (FIG. 5), in order to move the print head 27 away from the right edge of the paper stack P, i.e., away from the temprary binding portions Pb at the right edge. Similarly, if the current line of characters has been printed in the leftward direction, the carriage drive motor 17 is operated to move the carriage 23 to the right by the predetermined distance "A", for moving the print head 27 away from the temporary binding portions Pb at the left edge of the paper stack P. Subsequently, the control section 14 commands, in the next step S9, the paper driver circuit 19 so as to operate the paper feed motor 20, thereby advancing the paper stack P to the next line. Since the distance "A" is determined to be sufficient for the print head 17 to clear the temporary binding portions Pb, the print head 17 is prevented from interfering with the binding portions Pb even when the paper stack P is advanced.

In the next step S10, the microcomputer 15 checks for the presence of a signal from the paper detector 35*a*, 35*b*, namely, checks to see if the trailing end of the paper stack P has passed the paper detector. If the signal from the paper detector 35*a*, 35*b* is not present (if the trailing end of the paper stack P has not been reached), step S10 is followed by step S2, to start the reception of a next set of printing data representative of the next line of characters. If the signal from the paper detector 35*b*, 35*b* is present, the microprocessor 15 goes to step S11 to reset the contents of the first and second memories 11, 12 to their initial setting. In this connection, it is noted that the initialization of the first memory is not an absolute requirement, since the data in this first memory 11 is updated upon reading of the first set of printing data for a new paper stack P. Step S11 is followed by step S2.

Figure 5:
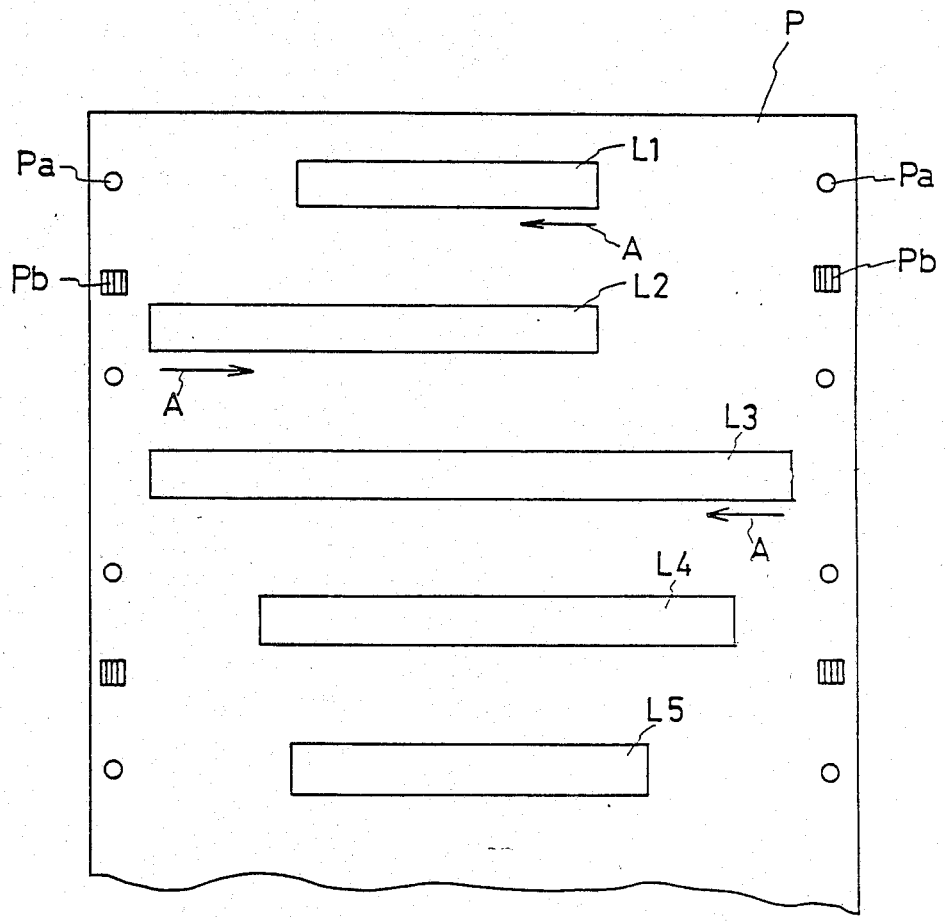
FIG. 5 is an illustrative view indicating movements of a print head relative to a recording medium.

Referring next to FIG. 5, an example of a printing cycle is illustrated. In the example, a first line L1 is printed in the rightward direction. Then, the first memory 11 stores the rightmost position data indicative of the rightmost character of the first line L1. In the meantime, the second memory 12 which has been initialized in step S11 at the end of the previous printing cycle, stores the rightmost position data, for example, a numerical value "0" as the initial setting. Therefore, the comparator section 13 judges that the rightmost position data stored in the first memory 11 is larger than the rightmost position data (initial setting value) stored in the second memory 12. In response to the first positional signal from the comparator section 13, which indicates the above judgement, the control section 14 operates to control the carriage drive motor 17 so as to move the carriage 23 in the leftward direction by the predetermined distance "A". Then, the paper feed motor 20 is actuated to advance the paper stack P to the next line, and the rightmost position data in the second memory 12 is replaced by the rightmost position data of the first line L1 stored in the first memory 11.

Suppose the second line L2 is printed in the leftward direction, the carriage 23 is moved to the position of the first character of the second line L2. Upon reading of the printing data for this second line L2, the leftmost position data of this line L2 is stored in the first memory 11, and the second line L2 is printed in the leftward direction. Since the initial setting value of the leftmost position data in the second memory 12 is selected to be sufficiently large, for example, "136" corresponding to the preset right margin position of the paper stack P, the leftmost position data of the second line L2 stored in the first memory 11 is smaller than the leftmost position data stored in the second memory 12. Consequently, the second position signal from the comparator section 13 causes the control section 14 to command the carriage drive motor 17, so as to move the carriage 23 in the rightward direction by the predetermined distance "A", at the end of printing of the second line L2. At the same time, the leftmost position data in the second memory 12 is replaced by the leftmost position data of the second line L2 in the first memory 11. The paper stack P is then advanced to the next line L3.

Upon reception of the following set of printing data for the third line L3 which is printed in the rightward direction, the rightmost position data of this line L3 is stored in the first memory 11. This rightmost position data is compared with the rightmost position data currently stored in the second memory 12, that is, with the rightmost position data of the first line L1. In this specific example, the rightmost character of the third line L3 is located to the right of the rightmost character of the first line L1, as indicated in FIG. 5. Therefore, the comparator section 13 judges that the rightmost position data in the first memory 11 is larger than the rightmost position data in the second memory 12. In response to the first position signal from the comparator 13, which indicates the above judgement, the control section 14 operates to move the carriage 23 in the leftward direction by the predetermined distance "A", at the end of printing of the third line L3. The rightmost position data in the second memory 12 is replaced by the rightmost position data of the third line L3 stored in the first memory 11.

The fourth line L4 is printed in the leftward direction. Since the leftmost character of this line L4 is located to the right of the leftmost character of the second line L2 whose position data is stored in the second memory 12, the carriage 23 is not moved in the rightward direction at the end of the leftward printing of the fourth line L4. Namely, the paper stack P is advanced to the next line L5 at the end of printing of the fourth line L4, without a non-printing rightward movement of the carriage 23. Similarly, the paper stack P is advanced to the next line at the end of the rightward printing of the fifth line L5, without a non-printing leftward movement of the carriage 23, because the rightmost character of the fifth line L5 is located to the left of the leftmost character of the third line L3 whose position data is stored in the second memory 12.

As is apparent from the foregoing description, the rightward and leftward movements of the carriage 23 to print the first and second lines (L1 and L2 in FIG. 5) are always accompanied by non-printing movements of the carriage 23 in the reverse directions (leftward and rightward directions, respectively). However, the non-printing movement of the carriage 23 at the end of printing of the subsequent lines will take place, only if the specified conditions are satisfied. More specifically, the carriage 23 is moved to the left at the end of rightward printing of a current line (third or subsequent line) only if the rightmost character of that current line is located at the same position as, or to the right of, the rightmost character of all the characters of the previous lines which have been printed in the rightward direction. Alternatively, the carriage 23 is moved to the right at the end of leftward printing of the current line only if the leftmost character of that current line is located at the same position, or to the left of, the leftmost character of all the characters of the previous lines which have been printed in the leftward direction. Stated differently, the non-printing movements of the carriage 23 will not take place as long as the printing operations are done within a range between the leftmost and rightmost character positions whose data are stored in the second memory 12. The above arrangement assures minimum reduction in overall printing efficiency due to the non-printing movements of the carriage 23, as well as prevents the print head 27 from interfering with the temporary binding portions Pb formed along the lateral edges of the paper stack P.

Although the paper stack P used in the illustrated embodiment are temporarily bound at their temporary binding portions Pb which are formed by special "paper Hotchkiss" punches, the principle of the invention may be practiced when the serial printer uses a multiple-copy or multiple-sheet printing material whose component sheets are temporarily bound by other binding or fastening means, for example, by applying glues or pastes to selected portions of the printing material.

It will be obvious to those skilled in the art that various other changes, modifications and improvements may be made in the invention, without departing from the spirit and scope of the invention defined in the appended claims.

What is claimed is:

1. A serial printer for printing on a recording medium consisting of a plurality of sheets which are superposed on each other and temporarily bound together with temporary binding means provided along opposite lateral edges of the medium, comprising:

a generally elongate platen for holding said recording medium;

feed means for feeding said recording medium in a direction perpendicular to a length of said generally elongate platen;

a print head disposed opposite to said platen, for effecting printing on said recording medium;

a carriage which supports said print head and is movable along said platen;

carriage drive means for moving said carriage along said platen;

first memory means for storing rightmost position data of a current line of characters printed by said print head, said rightmost position data being indicative of a position of a rightmost character of said current line;

second memory means for storing rightmost position data of a first previous line of characters whose rightmost character is the rightmost character of all the characters of at least previous lines which have been printed in a rightward direction before said current line of characters is printed, said rightmost position data of said first previous line being indicative of a position of said rightmost character of said first previous line;

comparator means for comparing said rightmost position data of said current line with said rightmost position data of said first previous line, and producing a first position signal indicating the position of said rightmost character of said current line with respect to the position of said rightmost character of said first previous line; and control means responsive to said first position signal from said comparator means, for activating only said paper feed means to advance said recording medium to a next line, at the end of printing of said current line in said rightward direction, if said first position signal indicates that said rightmost character of said current line is located to the left of said rightmost character of said first previous line, said control means activating said carriage drive means to move said carriage in a leftward direction by a predetermined distance at the end of printing of said current line, before activating said paper feed means to advance said recording medium to the next line, if said first position signal indicates that said rightmost character of said current line is located at the same position as, or to the right of, said rightmost character of said first previous line.

2. A serial printer according to claim 1, wherein said rightmost position data to be stored in said second memory means is indicative of the rightmost character of all the characters of all previous lines which have been printed by said print head before said current line of characters is printed.

3. A serial printer according to claim 1, wherein said first memory means further stores leftmost position data of said current line indicative of a position of a leftmost character of said current line, and said second memory means further stores leftmost position data of a second previous line of characters whose leftmost character is the leftmost character of all the characters of at least previous lines which have been printed in a leftward direction before said current line of characters is printed, said leftward position data of said second previous line being indicative of a position of said leftmost character of said second previous line, said comparator means comparing said leftmost position data of said current line with said leftmost poisiton data of said second previous line, and producing a second position signal indicating the position of said leftmost character of said current line with respect to the position of said leftmost character of said second previous line, said control means being responsive to said second position signal from said comparator means, for activating only said paper feed means to advance said recording medium to the next line, at the end of printing of said current line in said leftward directon, if said second position signal indicates that said leftmost character of said current line is located to the right of said leftmost character of said second previous line, said control means activating said carriage drive means to move said carriage in a rightward direction by a predetermined distance at the end of printing of said current line, before activating said paper feed means to advance said recording medium to the next line, if said second position signal indicates that said leftmost character of said current line is located at the same position as, or to the left of, said leftmost character of said second previous line.

4. A serial printer according to claim 1, further comprising:

detector means for sensing said recording medium and producing a detection signal indicating an end of said recording medium when said recording medium is not sensed; and means responsive to said detection signal from said detector means, for resetting the contents of said second memory means to a predetermined initial setting.

5. A serial printer for printing on a recording medium consisting of a plurality of sheets which are superposed on each other and temporarily bound together with temporary binding means provided along opposite lateral edges of the medium, comprising:

a generally elongate platen for holding said recording medium;

feed means for feeding said recording medium in a direction perpendicular to a length of said generally elongate platen;

a print head disposed opposite to said platen, for effecting printing on said recording medium;

a carriage which supports said print head and is movable along said platen;

carriage drive means for moving said carriage along said platen;

first memory means for storing lefttmost position data of a current line of characters printed by said print head, said leftmost position data being indicative of a position of a leftmost character of said current line;

second memory means for storing leftmost position data of a previous line of characters whose leftmost character is the leftmost character of all the characters of at least previous lines which have been printed in a leftward direction before said current line of characters is printed, said leftmost position data of said previous line being indicative of a position of said leftmost character of said previous line;

comparator means for comparing said leftmost position data of said current line with said leftmost position data of said previous line, and producing a position signal indicating the position of said leftmost character of said current line with respect to the position of said leftmost character of said previous line; and control means responsive to said position signal from said comparator means, for activating only said paper feed means to advance said recording medium to a next line, at the end of printing of said current line in said leftward direction, if said position signal indicates that said leftmost character of said current line is located to the right of said leftmost character of said previous line, said control means activating said carriage drive means to move said carriage in a rightward direction by a predetermined distance at the end of printing of said current line, before activating said paper feed means to advance said recording medium to the next line, if said position signal indicates that said leftmost character of said current line is located at the same position as, or to the left of, said leftmost character of said previous line.

6. A serial printer according to claim 5, wherein said leftmost position data to be stored in said second memory means is indicative of the leftmost character of all the characters of all previous lines which have been printed by said print head before said current line of characters is printed.

* * * * *